United States Patent [19]

Petry

[11] Patent Number: 4,792,169

[45] Date of Patent: Dec. 20, 1988

[54] OPEN LOWER SASH VENTILATION SAFETY LOCK

[76] Inventor: William E. Petry, 331 Hyde Ave., Council Bluffs, Iowa 51501

[21] Appl. No.: 535,709

[22] Filed: Sep. 26, 1983

[51] Int. Cl.[4] ..... E05C 17/30

[52] U.S. Cl. ..... 292/305; 292/276

[58] Field of Search ..... 292/338, 339, 276, 305, 292/306, 259; 248/354.3; 211/105.4

[56] References Cited

U.S. PATENT DOCUMENTS

| | | | |
|---|---|---|---|
| 392,000 | 10/1888 | Anderson et al. | 292/305 |
| 2,844,843 | 7/1958 | Logan | 292/305 X |
| 3,136,290 | 6/1964 | Bailey et al. | 292/305 X |
| 3,831,329 | 8/1974 | Lear | 248/354.3 X |
| 4,005,889 | 2/1977 | Patrick | 292/305 X |

FOREIGN PATENT DOCUMENTS

| | | | |
|---|---|---|---|
| 533569 | 11/1956 | Canada | 248/354.3 |
| 12753 | 6/1902 | United Kingdom | 292/276 |

*Primary Examiner*—Richard E. Moore

[57] ABSTRACT

In a double-hung window system of the type having upper and lower ventilating sliding sashes and a lock having a lapping assembly having upper and lower vertical lapping members the closer ends of which form a stop assembly together with a stop means cooperative therewith for stopping upward movement of the lower lapping member with respect to the upper lapping member. The upper lapping member is attached to the upper sash and the lower lapping member is attached to the lower sash whereby, with the window system open for ventilation, the amount of opening space available to a burglar who seeks to enter is limited so long as the lapping remains in place. The new feature thereof being means anchoring the upper end of the lapping assembly to the window frame so that a burglar cannot reach from the outside to the upper end of the frame anchored lapping assembly for forcing it inward out of its locking position.

5 Claims, 1 Drawing Sheet

OPEN LOWER SASH VENTILATION SAFETY LOCK

BACKGROUND OF THE INVENTION

In the past, considerable attention has been given to the problem of locking windows that are purposely left partially open for ventilation.

Various systems have been proposed, in one a vertical tube receives a threaded shaft and a nut on the threaded shaft prevents excessive telescoping together of the shaft and tube to limit the opening of the window, but the brackets proposed were such as to permit the entire telescoping assembly to be moved horizontally inward from the window for easy removal from the brackets by a person wanting to open the window in case of fire.

However, such an ease of horizontal removal also permits a burglar to push the telescoping assembly inward and, therefore, out of the way and out of action so he can enter easily. Because of this, a complicated and costly and bulky and unsightly alarm system was needed to further work with the telescoping system.

However, it is believed that a burglar could not so quickly see this possibility and would also find that he would be making some noise in the process of doing this from the outside. Burglars are reluctant to enter a house while making noise which is why burglars tend to avoid just breaking the glass and unlocking whatever locks there are that way.

Some have proposed attaching the telescoping member to the top of the outer and upper sash by means of a screw, but yet simply allowing the lower end of the telescoping assembly to be rested on but not screwed into the top of the lower sash. This would permit a burglar to insert a tool through the ventilation opening under the lower sash, the tool being especially proportioned to reach up and hook behind the lower end of the telescoping assembly so that the burglar could flip it inward off of the top of the lower sash and thereby enter without breaking glass.

Other proposals have had no attachment to the window frame itself. It is an object of this invention to provide an upper mounting bracket which attaches not only to the top of the upper sash, but also to the window frame itself so that the upper window sash cannot be lowered by a burglar for the purpose of inserting his hands and a screw-driver through that upper opening so as to unscrew the upper mounting bracket.

Some have proposed the placing of a telescoping assembly at the center of a window, but there it obstructs vision as one looks out through the window.

DESCRIPTION OF THE PREFERRED EMBODIMENT

Figure 2:
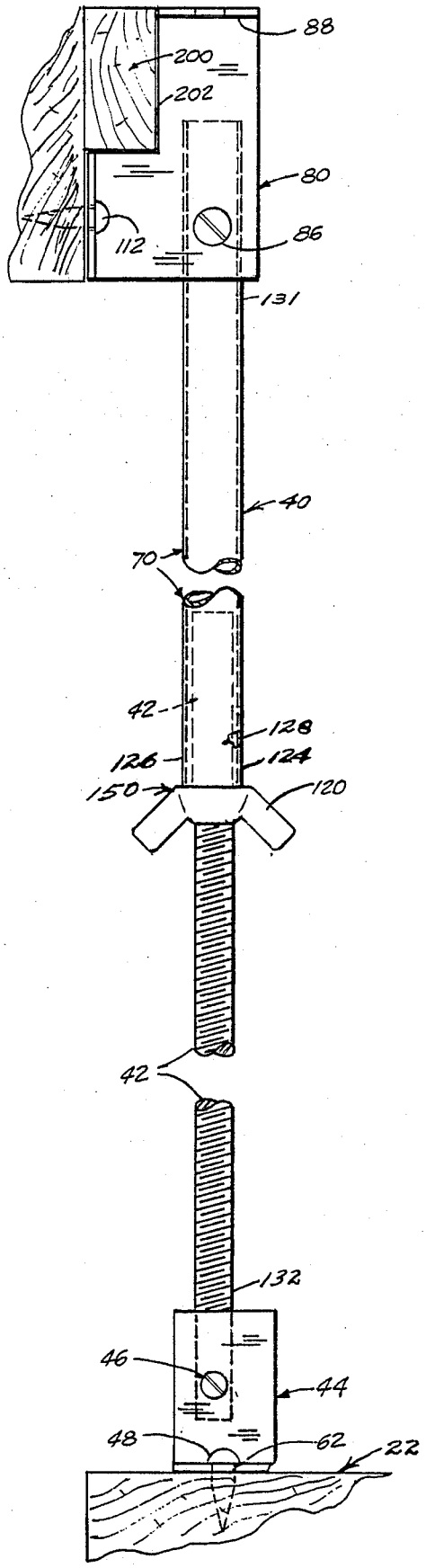
FIG. 2 is a view showing the lock of FIG. 1 as it would be seen on the left-hand side of FIG. 1, portions of the window frame and lower sash showing.

A double-hung window system is generally indicated at 10 having a frame generally indicated at 12 with a side piece 14 extending vertically and a top piece 16 extending horizontally. Beneath the top piece 16 is the upper sash 20 of the double-hung window and the lower sash thereof is seen at 22. The upper sash 20 has an upper member 24. It also has a lower member which extends horizontally like the upper member 24 and a portion of the latter is seen at 26 extending out from behind the upper member 28 of the lower sash 22 as it is possible to show by breaking off a bit more of the lower sash upper member 28, as a way of illustration.

The object of the invention is to provide a lock shown at 40 which will prevent the lower sash 22 from being raised more than desired.

The lock 40 has an upwardly extending threaded shaft 42 fixed in a lower bracket 44 by means of a bolt 46 extending through the bracket 44 and the lower end of the shaft 42.

The lower bracket 44 has a pair of screws 48, which latter extend into the upper member 28 of the lower sash 22 upon which latter lower member a bracket 44 rests.

Figure 1:
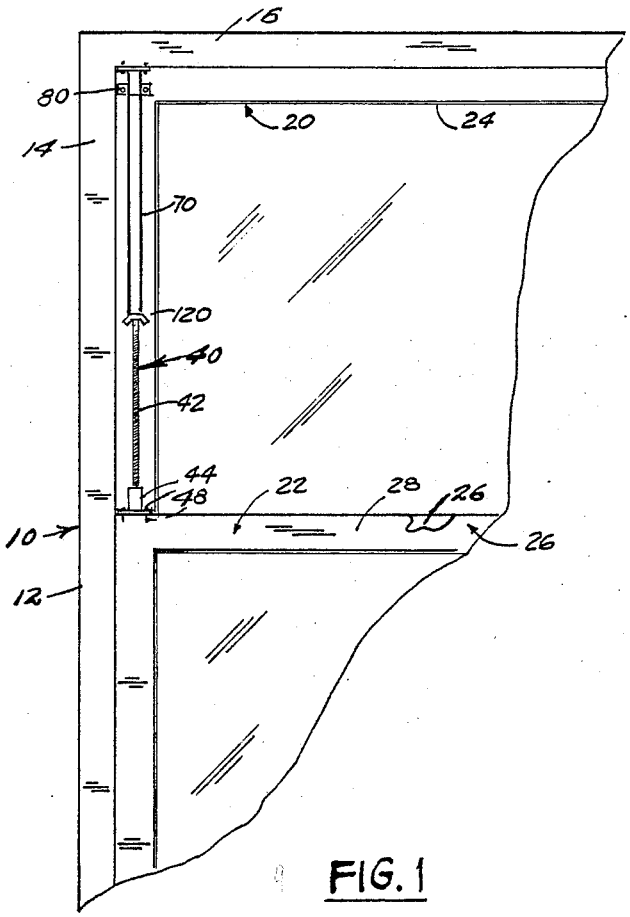
FIG. 1 is a frontal elevation of the lock of this invention shown as installed on a double-hung window system with the left upper section of the window system only being shown.

The bracket 44 has wings 50 extending horizontally and it is through the base wings 50 that vertical openings are provided at 62 for receiving the screws 48, as best seen in FIG. 1.

The upper end of the shaft 42 is received in the lower end of a tube 70 which extends from its lower end 72 located between the upper side of the lower sash upper member 28 and the underside of the top frame member 16 of the window system 10.

Figure 3:
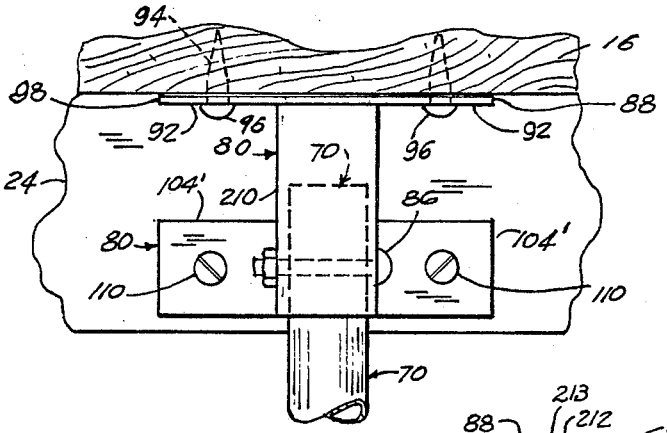
FIG. 3 is a frontal elevation detail showing the upper bracket area with adjacent parts broken away.
Figure 4:
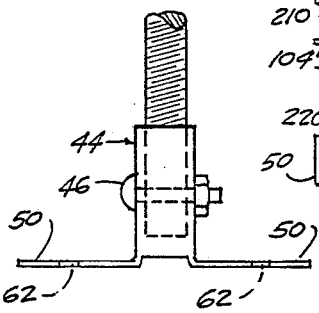
FIG. 4 is a frontal elevation of the lower bracket and a portion of the shaft.
Figure 5:
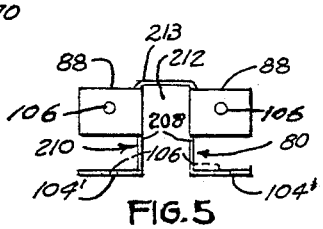
FIG. 5 is a top plan view of the upper bracket.
Figure 6:
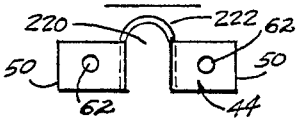
FIG. 6 is a bottom plan view of the lower bracket.

The tube 70 extends substantially vertically upward to an upper bracket seen in detail in frontal elevation in FIG. 3.

The tube 70 extends into a socket 212 of an upper bracket 80 and is held thereby a suitable keeper or bolt 86 extending through the sides 208 of a U-shaped main or central portion 210 of the upper brackets 80.

In a broad sense, the tube 70 and shaft 42 provide a lapping assembly generally indicated at 124 and comprising upper and lower lappers defined by the tube 70 and shaft 42, such lappers having lapping first end portions 126 and 128 respectively.

Each of the lappers 70 and 42 have a second end portion 131 and 132 respectively, which latter are attached to the brackets 80 and 44 respectively.

The brackets 80 and 44 respectively can also be called upper and lower mountings 80 and 44, in a broader sense.

A stop assembly 150 comprises a lapping first end portion 126 and 128 of the lappers 70 and 42 respectively.

The upper mounting or bracket 80 and lower mounting or bracket 44 each have a uniform thickness since they are each made of a single piece of sheetmetal formed, bent and punched into a special shape. This uniform thickness can be described as extending through either one of the mountings in any direction outwardly from the recess or socket in the mounting that receives the respective lapper.

It is from the foward parts of the side portions 208 that two vertical wings 104 extend respectively to the right and left.

Each vertical wing 104' is substantially in a verticle plane and has an opening 106 extending horizontally therethrough receiving a screw 110 attaching it to the upper left corner of the upper sash 20.

I claim:

1. An open window lock for a double-hung window system, the system having a frame, an upper sash and a lower sash, the lock comprising: a lapping assembly comprising upper and lower vertically extending elongated lappers having lapping first end portions, each of said lappers having a second end portion adapted to be mounted on window elements, upper and lower mountings attached to the second end portions respectively of said upper and lower lappers, portions of said lappers that are in the close vicinity of said lapping end portions defining stoppable portions, a stop assembly comprising said stoppable portions and a shiftable stop, said shiftable stop being operably correlated with said stoppable portions for releasably stopping upward movement of said lower lapper with respect to said upper lapper, said lower mounting having opening means extending therethrough for receiving screw means to attach said lower mounting to said lower sash, said upper mounting having opening means extending vertically and horizontally therethrough for receiving screw means for attaching said upper mounting to said window frame and to said upper sash respectively, whereby said upper sash is anchored to said frame for preventing a burglar from lowering said upper sash for access of a screwdriver to remove screw means from said upper mounting.

2. The open window lock for a double-hung window system of claim 1 having said upper mounting having a forward side and a rearward side and having a recess therein opening toward said forward side and receiving a part of the upper one of said lappers, said upper mounting having a main section of U-shape and having two side portions, two wings disposed substantially in vertical planes and extending each from one of said side portions respectively for attachment to said upper sash, said upper mounting having a uniform thickness dimension therethrough in any direction outwardly from said recess for facilitating economical formation from sheet metal.

3. The open window lock for a double-hung window system of claim 2 having said upper mounting main sections having frame element notch means on said forward side thereof and extending from right to left therethrough add disposed above said wings respectively to receive a frame element.

4. The open window lock of claim 1 having the attachment of said lower mounting to the respective second end portion being sufficiently permanent that disconnection without destruction cannot be done by a mere pushing of said lappers horizontally.

5. The open window lock of claim 1 having said upper mounting having notch means extending into one side and into the top thereof for receiving a frame element, and in further combination with a window frame having an element received in said notch means.

* * * * *